United States Patent [19]

Goloff

[11] 4,070,137

[45] Jan. 24, 1978

[54] ROTARY MECHANISM WITH A CONTINUOUS CURVE AT THE CHAMBER WAIST

[75] Inventor: Alexander Goloff, East Peoria, Ill.

[73] Assignee: Caterpillar Tractor Co., Peoria, Ill.

[21] Appl. No.: 730,494

[22] Filed: Oct. 7, 1976

[51] Int. Cl.[2] ..... F01C 1/02; F01C 19/04; F04C 17/02; F02B 55/14

[52] U.S. Cl. ..... 418/61 A; 418/113

[58] Field of Search ..... 418/61 A, 113, 120–124; 123/8.45

[56] References Cited

U.S. PATENT DOCUMENTS

| | | | |
|---|---|---|---|
| 2,988,008 | 6/1961 | Wankel | 418/113 |
| 3,193,189 | 7/1965 | Rastogi | 418/122 |
| 3,323,498 | 6/1967 | Kraic et al. | 418/122 |
| 3,764,239 | 10/1973 | Huf | 418/61 A |

FOREIGN PATENT DOCUMENTS

| | | | |
|---|---|---|---|
| 583,035 | 12/1946 | United Kingdom | 418/61 A |
| 995,551 | 6/1965 | United Kingdom | 418/124 |

*Primary Examiner*—John J. Vrablik

*Attorney, Agent, or Firm*—Wegner, Stellman, McCord, Wiles & Wood

[57] ABSTRACT

An improved rotary mechanism including a housing having a chamber with a wall of a predetermined geometric shape including at least one lobe, the lobe being defined by a continuous curve, a shaft journalled in the housing and having an eccentric within the chamber, a rotor journalled on the eccentric for rotation and translation within the chamber, the rotor having plural apexes, each being provided with an apex seal receiving groove, the wall of the housing deviating from the predetermined geometric shape by being spaced outwardly from the envelope of the predetermined geometric shape and by being generally spaced inwardly from the envelope of a closed geometric figure spaced outwardly of and parallel to the predetermined geometric shape. The closed geometric shape has sharp transition points at the lobes and the wall at the lobes is defined by a continuous curve substantially encompassing the sharp transition points and extending to both sides thereof. Apex seals are disposed within the grooves and have arcuate crowns sealingly engaging the wall. The crowns are relieved on both sides of the midpoints thereof from the theoretical shape required to ensure good sealing engagement with a wall configured in the form of the closed geometric figure with minimal movement within the grooves. Thus, the seals can be wider than in conventional rotary mechanisms and provide a greater area of contact with the wall to decrease the wear rate.

3 Claims, 4 Drawing Figures

ROTARY MECHANISM WITH A CONTINUOUS CURVE AT THE CHAMBER WAIST

BACKGROUND OF THE INVENTION

This invention relates to rotary mechanisms such as rotary engines, pumps, compressors, expanders, or the like.

Prior art of possible relevance includes U.S. Pat. No. 3,764,239.

Rotary mechanisms of the type having rotors mounted for rotation and translation within a chamber can be categorized into two types. In one type, the housing wall will have one or more lobes each having a relatively sharp transition point. An example of this type of mechanism is a hypotrochoidal mechanism of the type disclosed in U.S. Pat. No. 3,323,498 issued June 6, 1967 to Kraic et al.

The other group consists of such mechanisms wherein one or more lobes do not have sharp transition points, that is, the curves at the lobes are continuous with relatively generous radii. A typical mechanism in this category is a so-called "Wankel", or epitrochoidal mechanism, or a so-called "Clarke" mechanism, sometimes known as a slant axis rotary mechanism. The present invention concerns itself with the latter category of rotary mechanisms.

In such mechanisms, long life has been a long sought goal. The principal difficulty in achieving the goal has been the inability to provide long lived seals, particularly apex seals on the rotor. In designing such mechanisms, the housing geometry normally includes one or more lobes which are in the form of continuous curves having generous radii and such geometry is determinative of rotor shape with the result that the rotors have rather sharp apexes and very narrow apex seals.

For example, the method of housing design employed today is generally that of the above identified U.S. Pat. No. 3,764,239, wherein the housing geometry is not a true epitrochoid but rather, is a closed geometric figure or shape spaced outwardly of a true epitrochoid and parallel thereto. The spacing is selected to be equal to the radius of the curved sealing portion of the apex seal. Such a design provides larger seals than would be possible if the housing followed the shape of a true epitrochoid, but even so, in the typical Wankel engine in commerical use today, sealing contact between an apex seal and the housing shifts no more than about 0.05 inches on the surface of the apex seal. The confinement of sealing contact to such a small area causes rapid wear, even when exotic materials are employed in forming the seals.

As far as is known, no consideration has been given to larger seals in such mechanisms, which larger seals would require the actual housing geometry to be spaced an even greater distance from the true epitrochoid on which the design is based. The use of larger radius seals would increase the distance over which sealing contact between an apex seal and the housing shifts to decrease the wear rate on any given part of the sealing surface to thereby provide longer life.

The apparent failure to consider such seals may be due principally to two factors. The first is inertia loading on the seals. Increasing the radius of the sealing surface of state of the art seals would significantly increase their mass, resulting in greater inertia forces during operation of the mechanism in which they are used if the apex seals are disposed in grooves which extend radially of the rotor, as is the case with an epitrochoidal mechanism, thereby increasing frictional forces and increasing the wear rate due to such inertia loading.

A second probable factor is the fact that as the housing shape is removed further and further from the true epitrochoid, as required by the increased radius of the seals, the housing geometry at the lobes changes from continuous curves having generous radii to abrupt curves having sharp transition points which may be in the form of either discontinuous curves or in the form of continuous curves having extremely small radii. As a consequence, high contact stresses would be present at the lobes so that the lubricating oil film would be virtually nonexistant. As a result, friction would be high and the temperature of the rubbing surface at the contact point (the conjunction temperature) would also be undesirably high, causing scuffing and rapid wear of the housing.

SUMMARY OF THE INVENTION

It is the principal object of the invention to provide a new and improved rotary mechanism of the type wherein the rotor rotates and translates within a housing. More specifically, it is an object of the invention to provide such a mechanism wherein the housing is of the type having a continuous curve of generous radii at its lobes and wherein the sealing contact area of seals on the rotor is considerably increased to increase seal life without sacrificing housing life.

An exemplary embodiment of the invention achieves the foregoing object in a rotary mechanism including a housing having a chamber with a wall of a predetermined geometric shape including at least one lobe, the lobe being defined by a continuous curve. A shaft is journalled in the housing and has an eccentric within the chamber and a rotor is journalled on the eccentric for rotation and translation within the chamber. The rotor has plural apexes, each being provided with an apex seal receiving groove. The wall of the housing deviates from the predetermined geometric shape by being spaced outwardly from the envelope of the predetermined geometric shape and by being spaced generally inwardly of the envelope of a closed geometric figure spaced outwardly of and parallel to the predetermined geometric shape and having a sharp transition point at the lobe or lobes therein. The wall at the lobe or lobes is defined by a continuous curve substantially encompassing the sharp transition point and extending to both sides thereof. Apex seals are within the grooves and have arcuate crowns sealingly engaging the wall. The crowns are relieved on both sides of the midpoints thereof from the theoretical shape required to assure good sealing with the wall configured in the form of the closed geometric figure with minimal movement within the grooves. As a result, the construction provides seals which are wider than in conventional rotary mechanisms and provide a greater area of contact with the wall to decrease the wear rate without increasing appreciably the wear rate of the wall.

In a highly preferred embodiment, the crowns of the apex seals are noncircular and have progressively decreasing radii to each side of the midpoints thereof.

Also in a preferred embodiment, the predetermined geometric shape is an epitrochoid having opposed lobes defining a waist.

Other objects and advantages will become apparent from the following specification taken in connection with the accompanying drawings.

DESCRIPTION OF THE PREFERRED EMBODIMENT

An exemplary embodiment of the invention will be described in connection with a four-cycle, epitrochoidal mechanism employed as an engine. However, it is to be understood that the invention is applicable to mechanisms used other than as engines as, for example, pumps, compressors, expanders, or the like and to mechanisms operating on other than four cycles. It will also be appreciated that the invention is applicable to mechanisms other than epitrochoidal mechanisms as, for example, slant axis rotary mechanisms or any other type of rotary mechanism including a rotor which undergoes rotation and translation within a chamber having at least one lobe and wherein the geometry on which the design is based includes a housing lobe or lobes wherein the lobes are defined by continuous curves having generous radii and wherein the rotor has two or more relatively sharp apexes.

For purposes of the invention, the term "generous radii" means a radius generating a curve at the lobe wherein no abrupt transition points are present, which transition points would result in the presence of high contact stress and/or conjunction temperatures. Because design requirements of mechanisms vary due to differences in intended output, rated speeds, design life, composition of rubbing parts, etc., a minimum radius that would be a generous radius according to the invention cannot be set forth in absolute terms. However, those skilled in the art will recognize that a generous radius is one whereat, for a given design power, rated speed and considering the composition of the rubbing components, will result in a housing that will meet or exceed the intended design life of the mechanism.

Figure 1:
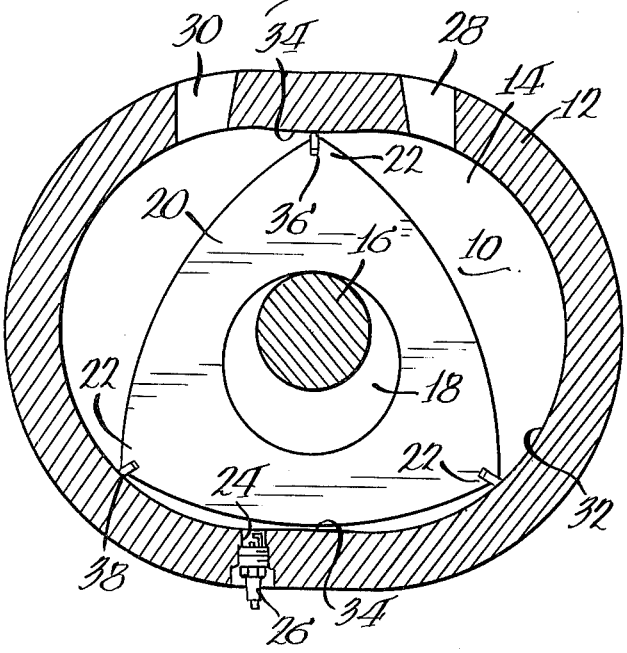
FIG. 1 is a somewhat schematic sectional view of a rotary mechanism, specifically, an epitrochoidal, four-cycle engine, made according to the invention.
Figure 4:
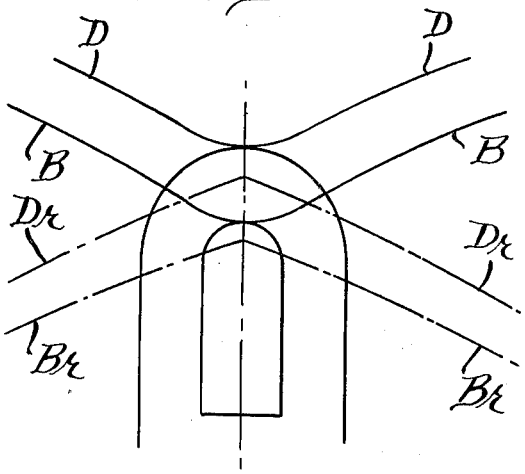
FIG. 4 is a composite of FIGS. 2 and 3.

Turning to FIG. 1, an exemplary embodiment of a rotary mechanism made according to the invention is illustrated in the form of an epitrochoidal, four-cycle engine, including a chamber 10 bounded by a center housing 12 and opposed end housings 14, only one of which is shown. The end housings 14 journal a shaft 16, and the shaft 16 includes an eccentric 18 within the chamber 10. A rotor 20 having three apexes 22 is journalled on the eccentric 18 within the chamber 10 and, upon relative rotation of the housing, the shaft and the rotor, will undergo translation and rotation within the chamber 10.

The center housing 12 includes a bore 24 for receipt of a spark plug 26 if the engine is to be used as a spark ignition engine. Alternately, if the engine is to be employed as a diesel engine, the bore 24 may be provided with a fuel injector.

Oppositely of the bore 24, the center housing 12 is provided with intake and exhaust ports 28 and 30, respectively, which are conventional in nature.

As can be seen, the center housing 12 includes an internal surface 32 provided with opposed lobes 34 which define the so-called "waist" of the engine. In addition, the rotor 20, at each apex, is provided with a radially extending, outwardly opening groove 36. Each of the grooves 36 receives an apex seal 38 for rubbing engagement with the internal surface 32.

As seen in FIG. 1, the axis of the uppermost seal 38 from top to bottom thereof is normal to the internal surface 32 at its point of contact. On the other hand, the seal 38, at the lower right-hand portion of FIG. 1, is contacting the surface 32 at an acute angle from the axis. That is, its point of contact is shifted to one side of the center of the seal.

The seal 38 in the lower left-hand portion of FIG. 1 is also contacting the surface 32 at an angle, meaning that its point of contact has shifted to the other side of the center of the seal. As is well known, each of the seals 38 will, at one time or another during the cycle, assume each of the three seal positions relative to the wall 32, as illustrated in FIG. 1. As mentioned above, this will result in the point of contact of each seal with the wall 32 in a conventional rotary mechanism of automotive size shifting about 0.05 inches.

Figure 2:
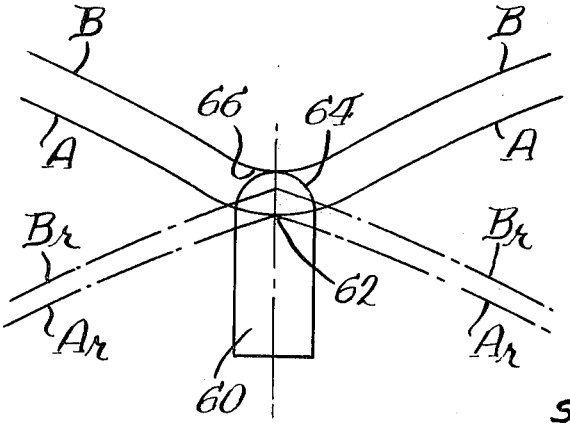
Fig. 2. PRIOR ART
FIG. 2 is a graphic view illustrating design of seals and mechanism housings according to the prior art.

FIG. 2 illustrates the usual design approach taken in the design of an epitrochoidal mechanism. An epitrochoid suitable for the purposes of the designer is first chosen and a portion of the true epitrochoid chosen is illustrated in FIG. 2 and designated A. Some desired radius for an apex seal 60 is chosen and from a point 62 on the seal, an arcuate sealing surface 64 forming part of a circle having the chosen radius is provided. The seal may then be moved along the outline of the true epitrochoid A with the point 62 lying thereon to trace a closed geometric figure, designated B, which would be parallel to the true epitrochoid A and spaced therefrom radially outwardly of the shaft 16 by a distance equal to the radius of the sealing surface 64. The internal surface 32 of the center housing 12 is then configured in the form of the shape B.

The true epitrochoid A would determine a rotor configuration shown in dotted lines at $A_r$ in FIG. 2. However, in order to maximize the compression ratio, because of the increased clearance due to the use of the curve B rather than the curve A for the housing, the rotor surface would then be configured to follow the line $B_r$ shown in FIG. 2, which will be outwardly of the line $A_r$ as far as possible without causing interference through contact with the surface 32.

Heretofore, the location of the curve B has always been chosen so as to never be so far removed from the true epitrochoid A as to have an abrupt transition point at each of the lobes in the surface 32, one such lobe being shown at 66.

Figure 3:
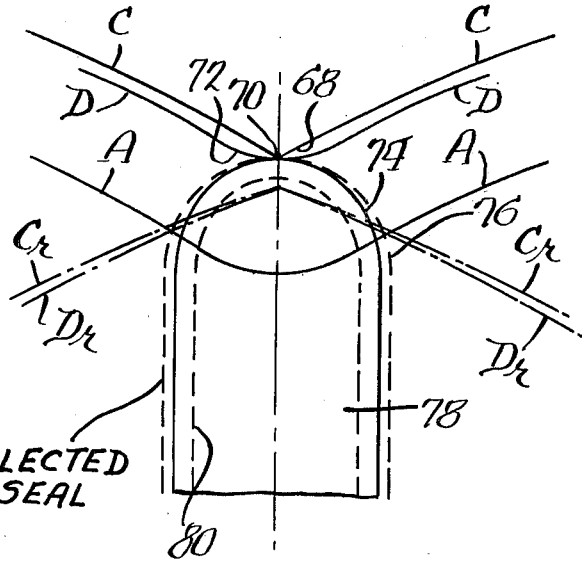
FIG. 3 is a view similar to FIG. 2, illustrating the design of seals and housings according to the present invention.

Turning now to FIG. 3, the construction of applicant's invention, as applied to an epitrochoidal mechanism, will be described in greater detail. Again, a desired epitrochoidal curve is selected by the designer and that curve is designated A in FIG. 3. A desired seal radius considerably greater than prior art seal radii is then selected based on intended seal material, intended housing material, rated speed, rated power, and other similar factors intended to be embodied in the mechanism by the designer. In FIG. 3, the seal radius is chosen to be approximately three times that of the prior art construction illustrated in FIG. 2.

Employing the increased seal radius, a closed geometric figure C is generated in the same fashion as the curve B in FIG. 2. That is, the figure C is spaced radially outwardly of the predetermined geometric shape, curve A, relative to the shaft 16 and parallels the curve A. Because of the increased radius of the seal, and the need to maintain equidistant spacing from the true epitrochoid A, it will be observed that the lobe 68 in the figure C has a very sharp transition point 70. While FIG. 3 illustrates the point as being on a discontinuous curve defining the lobe 68, the sharp transition point 70 could be on a continuous curve of a small radius less than a generous radius as defined previously herein.

Considering again the same factors employed in choosing the seal radius, and mentioned above, the designer will then select a curve 72 having a sufficiently generous radius so as to avoid the presence of high contact stresses and/or conjunction temperatures given the basic design parameters and locate such a curve radially inwardly of the curve C. The curve is designated D and passes through, that is substantially encompasses, the transition point 70 in the curve C. As a consequence, at its midpoint, the radius of the seal will remain equal to that chosen according to the steps mentioned previously. However, because the curve D, at all points other than the transition point 70 and points whereat the seals are normal to the wall, is located radially inwardly of the curve C, it is necessary to relieve the rubbing surface of the seal to either side of its midpoint, as illustrated by comparing the seal contacting surface 74 shown in FIG. 3 with a line 76 which is based on the selection of the original radius. As can be seen, the surface 74 is of progressively increasing radii (that is, the curve becomes flatter) from the midpoint of the seal over the contact area of the crown. The degree of relief varies over the contact area and is chosen so as to minimize movement of the seal in and out of its groove 36.

As a consequence of the foregoing, the length of the seal contact area will be extended to about two and one-half times that of a prior art mechanism wherein the seals undergo identical angular shifts with respect to the surface 32. Thus, seal life is considerably increased, allowing the manufacture of longer lived mechanisms and/or the use of less exotic materials in fabricating the seal 78. At the same time, high contact stresses or conjunction temperatures at the lobe or lobes of the mechanism are avoided by reason of provision of a generous curve, such as the curve 72, extending through the transition point 70.

Because of the increased mass of the seal 78, there may be increased inertia loading conducive to increased wear rates. However, because the size of the seal has been considerably increased, it is also easier to make the seal 78 hollow, as illustrated at 80, to lessen its mass, thereby reducing inertia loading.

The last step in the design process involves some reduction of the size of the rotor from that which might ordinarily be expected to be used according to the prior art. The use of the curve C would allow a rotor configuration following the curve $C_r$ shown in FIG. 3, which curve will be determined in the same manner as the curve $B_r$. However, because at points other than at the lobes, the actual housing shape will follow the curve D rather than the curve C, the rotor periphery should follow a curve, generally inside the curve $C_r$, such a curve being designated $D_r$ in FIG. 3, selected to avoid interference with the surface 32.

While the invention has been described in connection with an epitrochoidal mechanism, it is not intended to be limited thereto except as expressly stated in the following claims as those skilled in the art will readily appreciate its applicability to other forms of engines as, for example, slant axis rotary engines.

What is claimed is:

1. A rotary mechanism comprising:

a housing including a chamber having a wall configuration based on a predetermined geometric shape including at least one lobe, said lobe being defined by a continuous curve;

a shaft journalled in the housing and having an eccentric within the chamber;

a rotor journalled on said eccentric for rotation and translation within said chamber, said rotor having plural apexes, each being provided with an apex seal receiving groove;

said wall deviating from said predetermined geometric shape by being spaced outwardly from the envelope of said predetermined geometric shape and by being generally spaced inwardly from the envelope of a closed geometric figure spaced outwardly of and parallel to said predetermined geometric shape and having a sharp transition point(s) at said lobe(s), said wall at said lobe(s) being defined by a continuous curve substantially encompassing said sharp transition point(s) and extending to both sides thereof; and apex seals within said grooves having arcuate crowns sealingly engaging said wall, said crowns being relieved on both sides of the midpoints thereof from the theoretical shape required to ensure good sealing engagement with a wall configured in the form of said closed geometric figure with minimal movement within the grooves;

whereby said seals are wider than in conventional rotary mechanisms and provide a greater area of contact with said wall to decrease the wear rate.

2. The rotary mechanism of claim 1 wherein said crowns are noncircular and have progressively increasing radii to each side of said midpoint.

3. An epitrochoidal rotary mechanism comprising:

a housing including a chamber having a wall based on an epitrochoid having opposed lobes defining a waist;

a shaft journalled in the housing and having an eccentric within the chamber;

a rotor journalled on said eccentric for rotation and translation within said chamber, said rotor having three spaced apexes, each being provided with an apex seal receiving groove;

said wall deviating from a true epitrochoid by being spaced outwardly from the envelope of the true epitrochoid and by being generally spaced inwardly from the envelope of a closed geometric figure spaced outwardly of and parallel to the true epitrochoid and having sharp transition points at said waist, said wall, at said waist, being defined by continuous curves substantially encompassing said sharp transition points and extending to both sides thereof; and apex seals within said grooves having arcuate crowns sealingly engaging said wall, said crowns being relieved on both sides of the midpoints thereof from the theoretical shape required to ensure good sealing engagement with a wall configured in the form of said closed geometric figure with minimal radial movement;

whereby said seals are wider than in conventional epitrochoidal rotary mechanisms and provide a greater area of contact with said wall to decrease the wear rate.

* * * * *